US010808480B2

(12) United States Patent
Hern et al.

(10) Patent No.: US 10,808,480 B2
(45) Date of Patent: Oct. 20, 2020

(54) FRAC PLUG SETTING METHOD

(71) Applicants: Gregory Hern, Porter, TX (US); YingQing Xu, Tomball, TX (US)

(72) Inventors: Gregory Hern, Porter, TX (US); YingQing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 116 days.

(21) Appl. No.: 16/195,244

(22) Filed: Nov. 19, 2018

(65) Prior Publication Data

US 2020/0157913 A1 May 21, 2020

(51) Int. Cl.
*E21B 23/06* (2006.01)
*E21B 33/128* (2006.01)

(52) U.S. Cl.
CPC ..... *E21B 23/065* (2013.01); *E21B 33/128* (2013.01); *E21B 33/1285* (2013.01)

(58) Field of Classification Search
CPC ... E21B 33/128; E21B 33/1285; E21B 23/065
See application file for complete search history.

(56) References Cited

U.S. PATENT DOCUMENTS

| | | | |
|---|---|---|---|
| 2,707,998 | A | 5/1955 | Baker et al. |
| 2,807,325 | A | 9/1957 | Webb |
| 3,024,843 | A | 3/1962 | Dean |
| 3,977,473 | A | 8/1976 | Page |
| 5,024,270 | A | 6/1991 | Bostick |
| 5,027,270 | A | 6/1991 | Bostick John |
| 7,017,672 | B2 | 3/2006 | Owen, Sr. et al. |
| 9,528,342 | B2 | 12/2016 | Xu et al. |
| 9,810,035 | B1 | 11/2017 | Carr et al. |
| 10,443,331 | B1 | 10/2019 | Andres et al. |
| 2004/0216868 | A1 | 11/2004 | Owen, Sr. |
| 2005/0230100 | A1 | 10/2005 | Hirth et al. |
| 2010/0230116 | A1 | 9/2010 | Harmon et al. |
| 2013/0186649 | A1 | 7/2013 | Xu et al. |
| 2014/0041857 | A1 | 2/2014 | Xu et al. |
| 2014/0190685 | A1 | 7/2014 | Frazier et al. |
| 2015/0129203 | A1 | 5/2015 | Deutch et al. |
| 2016/0290093 | A1 | 10/2016 | Doane et al. |
| 2017/0130553 | A1 | 5/2017 | Harris et al. |
| 2017/0234108 | A1 | 8/2017 | Xu |
| 2018/0016859 | A1* | 1/2018 | Stair ..... E21B 33/1208 |

(Continued)

OTHER PUBLICATIONS

International Search Report and Written Opinion for Intnerional Application No. PCT/US2019/061806; International Filing dated Nov. 15, 2019; Report dated Mar. 11, 2020 (pp. 1-10).

(Continued)

*Primary Examiner* — Robert E Fuller
(74) *Attorney, Agent, or Firm* — Cantor Colburn LLP

(57) ABSTRACT

A downhole tool includes a setting tool having an outer surface, an inner surface defining a passage and a terminal end. An actuator mechanism is arranged in the passage. A setting member is arranged at the terminal end in the passage. The setting member includes a side portion that is angled radially inwardly from a first end portion to a second end portion. A collet member extends over the setting member, and a seal member is operatively connected to the collet member at the second end portion of the setting member.

10 Claims, 12 Drawing Sheets

(56) References Cited

U.S. PATENT DOCUMENTS

| | | | |
|---|---|---|---|
| 2018/0051532 | A1 | 2/2018 | Smith et al. |
| 2020/0157900 | A1 | 5/2020 | Hern et al. |
| 2020/0157915 | A1 | 5/2020 | Hern et al. |

OTHER PUBLICATIONS

International Search Report and Written Opinion for Intnerional Application No. PCT/US2019/061911; International Filing dated Nov. 18, 2019; Report dated Mar. 12, 2020 (pp. 1-11).
International Search Report and Written Opinion for Intnerional Application No. PCT/US2019/061914; International Filing datet Nov. 18, 2019; Report dated Mar. 16, 2020 (pp. 1-11).

* cited by examiner

FRAC PLUG SETTING METHOD

BACKGROUND

In the resource exploration and recovery industry, boreholes are formed to test for and recover formation fluids. During testing and extraction, various tools are deployed into the borehole. A frac plug may be used to initiate a fracture in a formation. Setting a frac plug, or other seal may require the use of drop balls, explosive charges or other tools that increase an overall cost and complexity of operation.

Typically, a force, initiated by the explosive charge, may urge a setting member into a seal. After initiating the charge, another tool, which extends through the seal, may be pulled upwardly to exert an upward tension forcing the seal along the setting member. Pressure may then be applied to a drop ball after the tool is removed. Accordingly, the art would be receptive of alternative methods for setting seals downhole.

SUMMARY

Disclosed is a downhole tool including a setting tool having an outer surface, an inner surface defining a passage and a terminal end. An actuator mechanism is arranged in the passage. A setting member is arranged at the terminal end in the passage. The setting member includes a side portion that is angled radially inwardly from a first end portion to a second end portion. A collet member extends over the setting member, and a seal member is operatively connected to the collet member at the second end portion of the setting member.

Also disclosed is a method of setting a downhole seal including delivering a fluid force onto a setting member, urging the setting member into a seal member, pulling on an outer surface of the seal member with a setting tool, and shifting the seal member along an angled surface of the setting member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
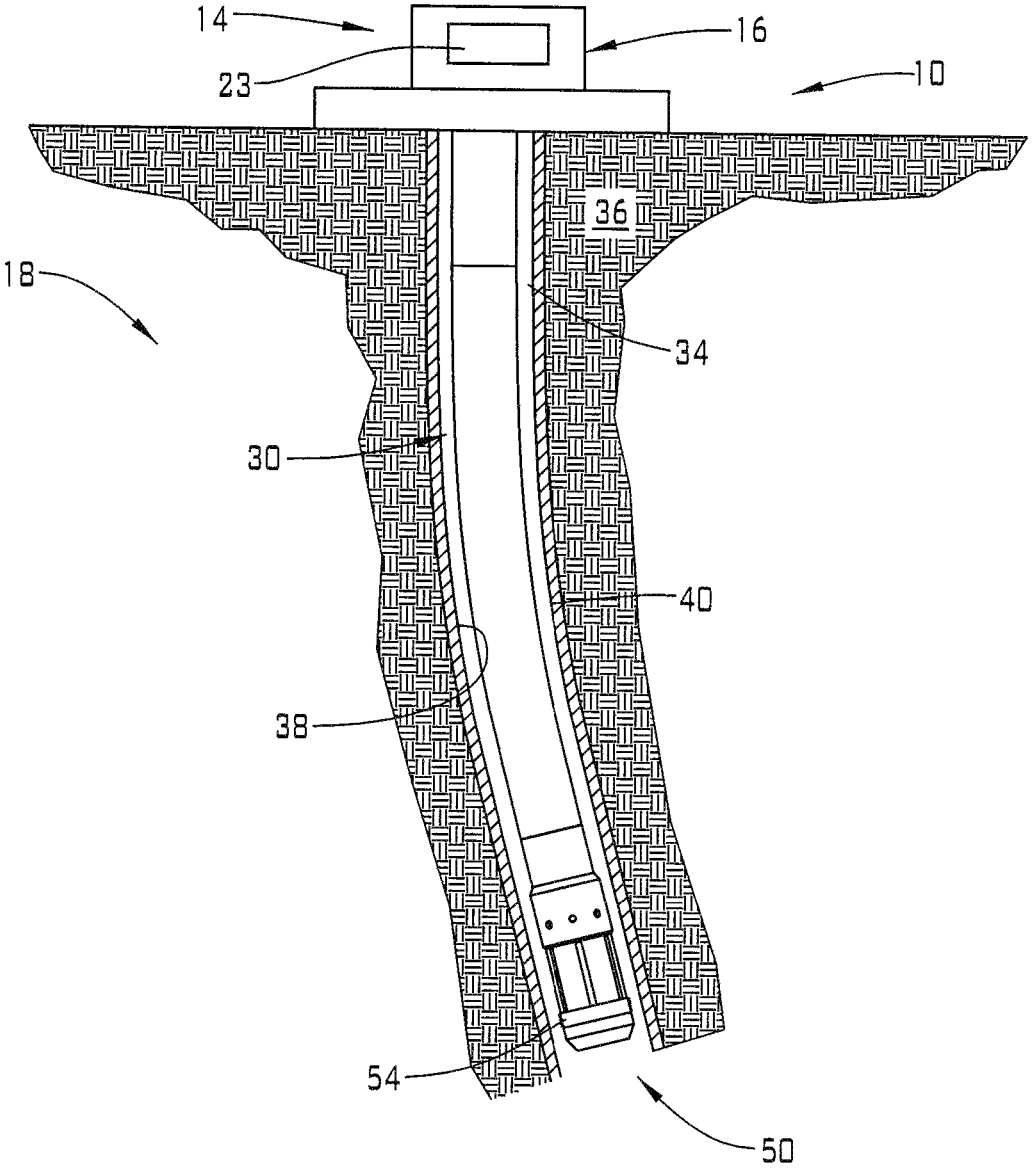
FIG. 1 depicts a resource exploration and recovery system including a frac plug setting system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a wireline 30 that extends into a wellbore 34 formed in formation 36. Wireline 30 may be operatively connected to control system 23. Wellbore 34 includes an annular wall 38 which may be defined by a surface of formation 36, or a casing tubular 40 such as shown.

Figure 2:
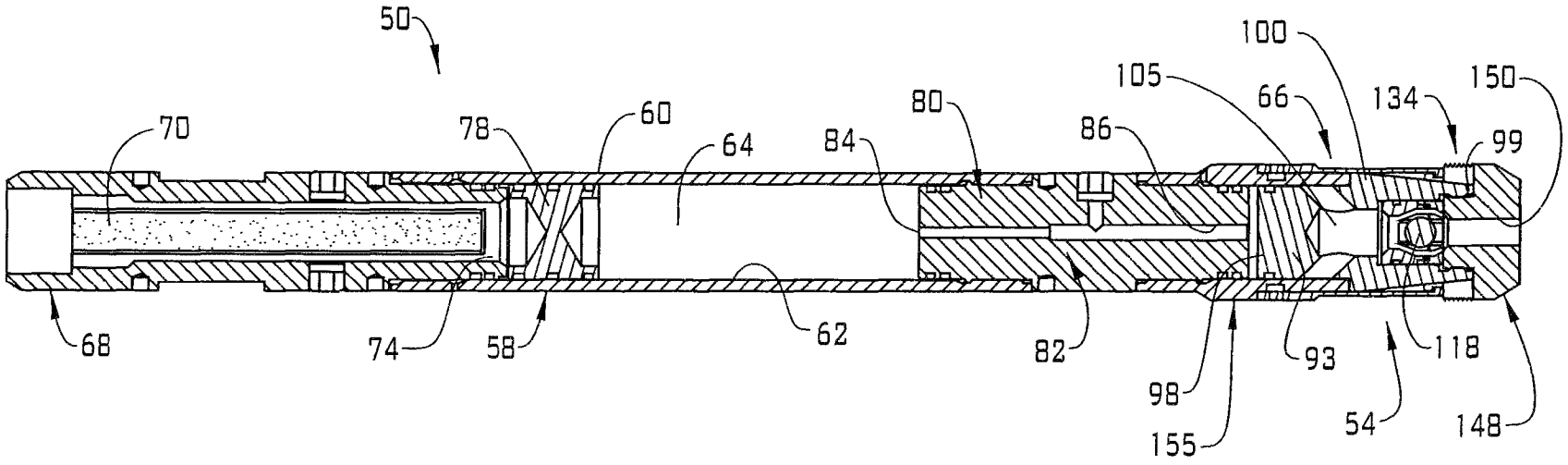
FIG. 2 depicts a cross-sectional view of a tool for setting a frac plug, in accordance with an aspect of an exemplary embodiment.
Figure 3:
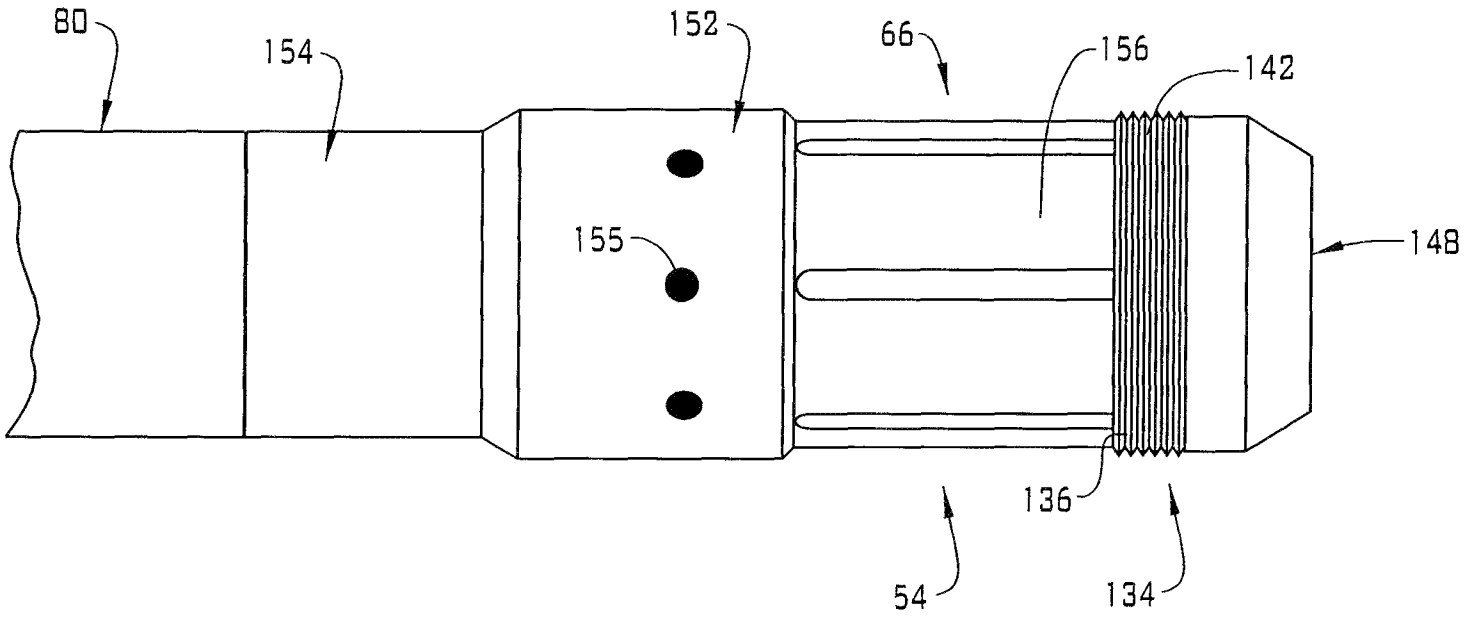
FIG. 3 depicts a terminal end portion of the tool of FIG. 2.
Figure 4:
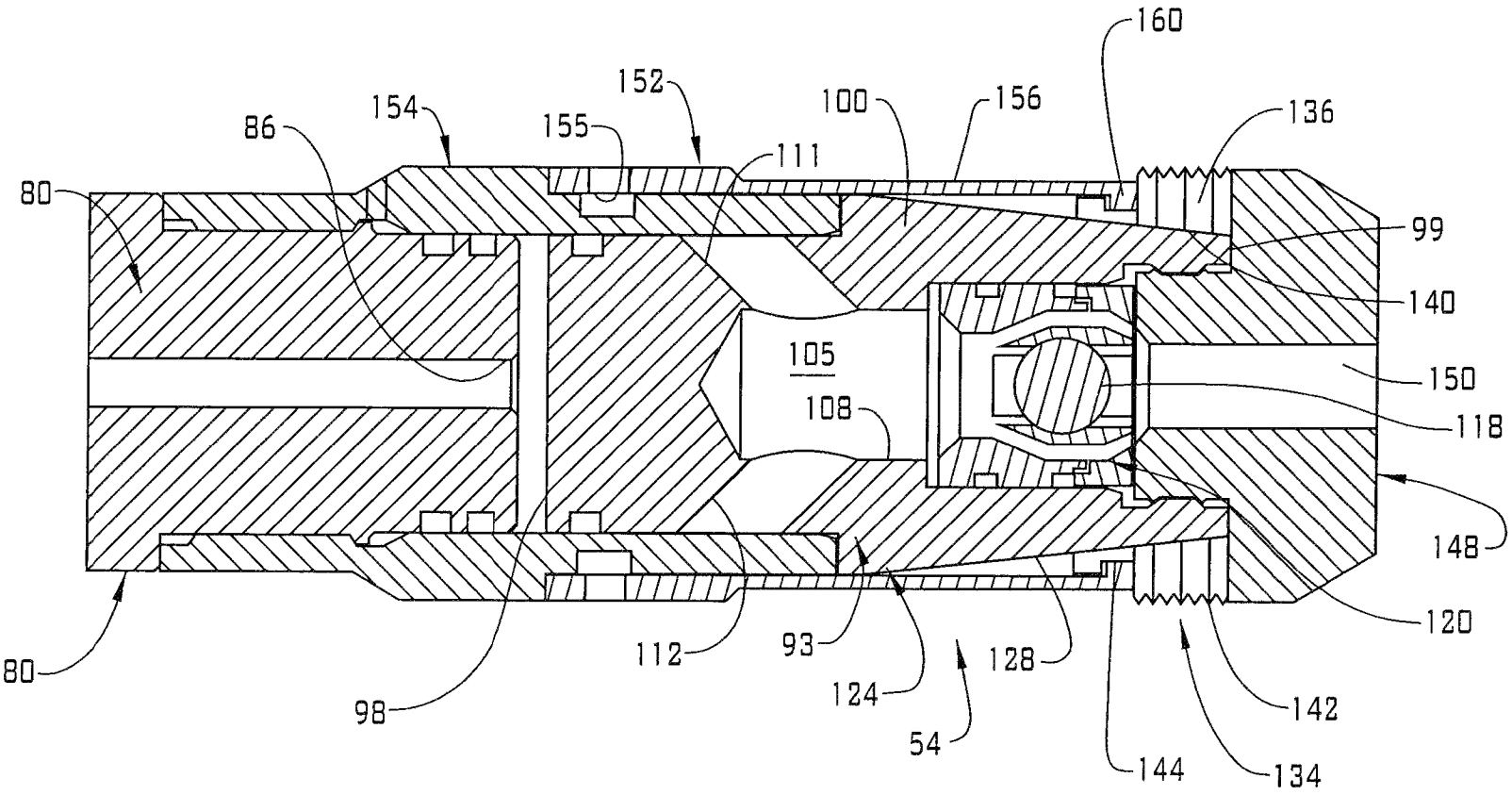
FIG. 4 depicts a cross-sectional view of the terminal end of the tool of FIG. 3 in a first or unset configuration, in accordance with an aspect of an exemplary embodiment.

In an exemplary aspect, wireline 30 supports a downhole tool 50. As will be detailed herein, downhole tool 50 may take the form of a frac plug 54 that may be selectively engaged with annular wall 38. Referring to FIGS. 2-4, downhole tool 50 includes a body 58 having an outer surface 60 and an inner surface 62 that defines a passage 64. Downhole tool 50 includes a terminal end 66 that may be selectively detached as will become more fully evident herein. An actuator mechanism 68, which may take the form of a power charge 70 is connected to body 58 at an end (not separately labeled) opposite terminal end 66. Actuator mechanism 68 produces high velocity gases that are directed along a gas path 74 towards a piston element 78.

In an embodiment, downhole tool 50 includes an actuator element 80 fixedly mounted in passage 64 axially spaced from piston element 78 towards terminal end 66. Actuator element 80 includes a central conduit 82 having a first end 84 having a first diameter and a second end 86 having a second diameter that is greater than the first diameter. First end 84 may be directly fluidically exposed to an actuator volume (not separately labeled) defined between piston element 78 and actuator element 80. Movement of piston element 78 compresses fluid arranged in the actuator volume. The fluid passes through central conduit 82 of actuator element 80 and acts upon a setting member 93. The different diameters of first and second ends 84 and 86 establishes a metered flow of fluid onto setting member 93.

In an embodiment, setting member 93 includes a first end portion 98 exposed to second end 86 of central conduit 82, a second end portion 99 and an intermediate portion 100. Setting member 93 includes a central cavity 105 that defines a central channel 108. A first conduit 111 and a second conduit 112 extend radially inwardly into central channel 108. A plug member 118 provided on a plug support 120 is arranged in central cavity 105. Plug member may be suspended in central cavity 105. In this manner, if perforating guns (not shown) fail to function, a pathway for fluid flow may remain. That is, fluid may pass into first and second conduits 111, 112, flow around plug member 118 and exit central channel 108. When fully set, plug member 118 may be unseated blocking fluid flow through setting member 93.

Setting member 93 includes a side portion 124 that angled inwardly from intermediate portion 100 toward second end 99. Side portion 124 defines a seal support 128 that is receptive of a seal member 134. Seal member 134 includes an outer surface 136 that may seal against annular wall 38, and an inner surface 140 that may shift upon side portion 124 of setting member 93. Seal member 134 may include a spiral cut (not separately labeled) that promotes radial outward expansion. Outer surface 136 includes a plurality of raised ridges or wickets 142 that extend about seal member 134. Outer surface 136 also includes a recess 144. In an embodiment, recess 144 may take the form of a recess 144. However, it should be understood that recess 144 may take on various forms and geometries and should not be considered to be limited to a groove, annular or otherwise. A carrier member 148 having a central opening 150 is positioned adjacent seal member 134. Central opening 150 registers with and is fluidically connected to, central channel 108.

In accordance with an exemplary embodiment, actuator member 80 is connected to a collet member 152 through an annular interface 154. A plurality of shear elements, one of which is indicated at 155, may connect collet member 152 to annular interface 154. Collet member 152 may include a plurality of collet fingers, one of which is indicated at 156. It should however be understood that collet member 152 may include a continuous outer annular surface that is expandable.

Each collet finger 156 includes a radially inwardly directed member 160 that extends into recess 144 on seal member 134. Collet fingers 156 may expand radially outwardly as seal member 134 is set. More specifically, actuator mechanism 68 may be triggered to direct a flow of high pressure gases onto piston element 78. Piston element 78 shifts toward setting member 93 urging a flow of fluid, such as oil, onto first end portion 98. Setting member 93 shifts into seal member 134. In another embodiment, actuator mechanism 68 may allow hydrostatic pressure to enter into central conduit 82, flow towards and act upon piston element 78.

Seal member 134 travels alongside portion 124 and expands radially outwardly aided by the spiral cut. In an embodiment, inwardly directed members 160 may be shearable or frangible. That is, inwardly directed members 160 may shear when collet fingers 156 are placed in tension. In this manner, collet fingers 156 may be disconnected from seal member 134 and withdrawn from wellbore 34. In another embodiment, seal member 134 may include a frangible portion. For example, a portion of seal member 134 that is uphole of recess 144 may be frangible. Thus, when collet fingers 156 are placed in tension, a portion of seal member 134 may give way allowing collect fingers 156 to be withdrawn from wellbore 34.

Figure 5:
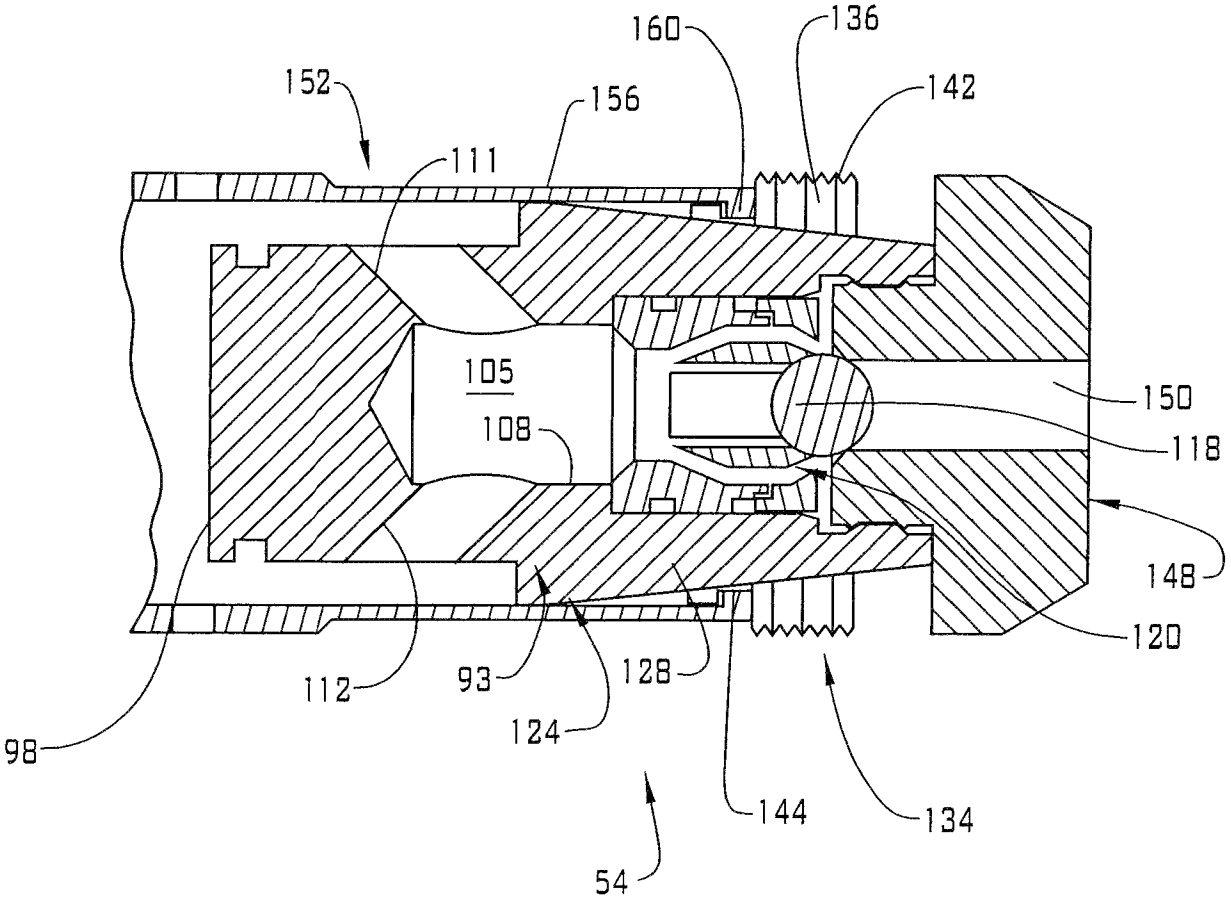
FIG. 5 depicts a cross-sectional view of the terminal end of the tool of FIG. 3 in a second or set configuration, in accordance with an aspect of an exemplary embodiment.

Downhole tool 50 may be placed in tension such that collet fingers 156 pull on outer surface 136 of seal member 134. The tension on outer surface 136 causes further radially outwardly directed expansion of seal member 134 such as shown in FIG. 5. When set, frac plug 54 may be released by breaking shear elements 155, and downhole tool 50 separated from terminal end 66. Perforating guns (not shown) supported on wireline 30 may be positioned above terminal end 66 and activated to selectively breach portions of casing tubular 40 prior to initiation of a fracturing operation. After breaching casing tubular 40, wireline 30 may be retrieved from wellbore 34. At this point, surface system 16 may pump fluid into wellbore 34 to release plug member 118. Plug member 118 seals central opening 150 prior to initiation of a fracturing operation as shown in FIG. 5

Figure 6:
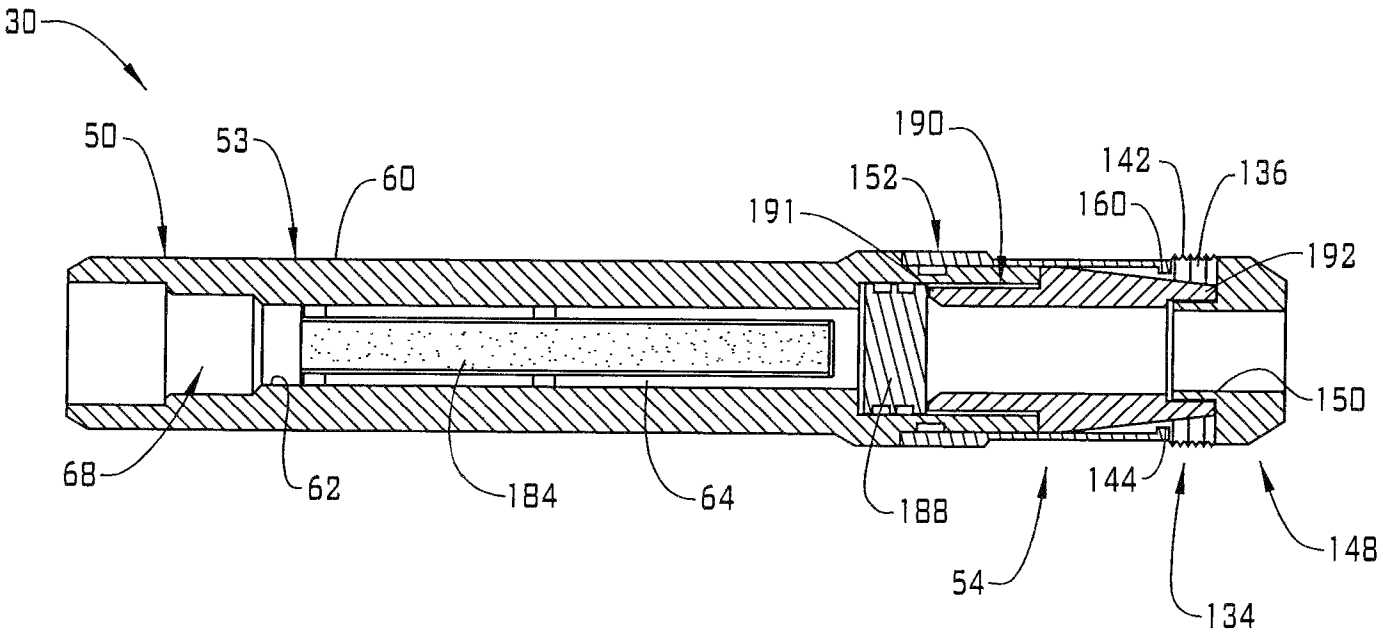
FIG. 6 depicts a cross-sectional view of a tool for setting a frac plug, in accordance with another aspect of an exemplary embodiment.
Figure 7:
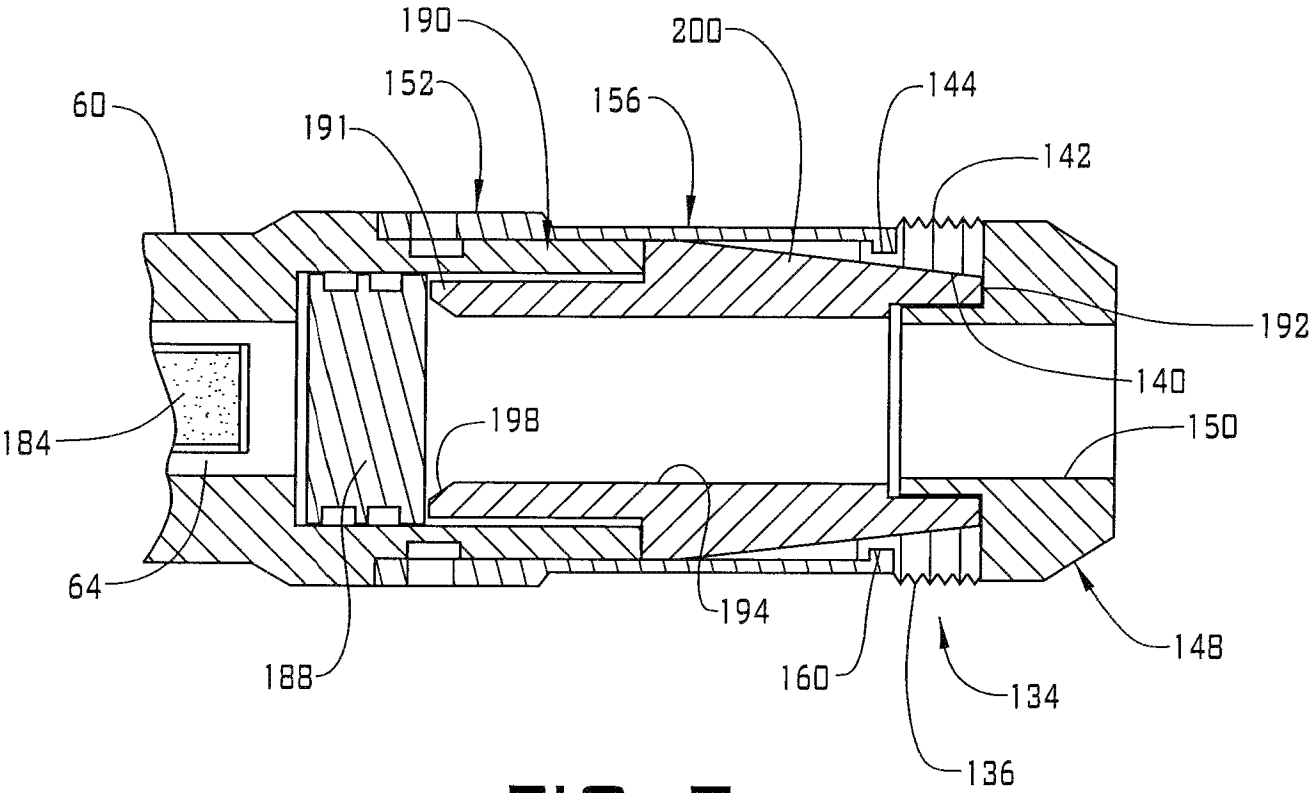
FIG. 7 depicts a cross-sectional view of the terminal end of the tool of FIG. 6 in a first or unset configuration, in accordance with an exemplary embodiment.
Figure 8:
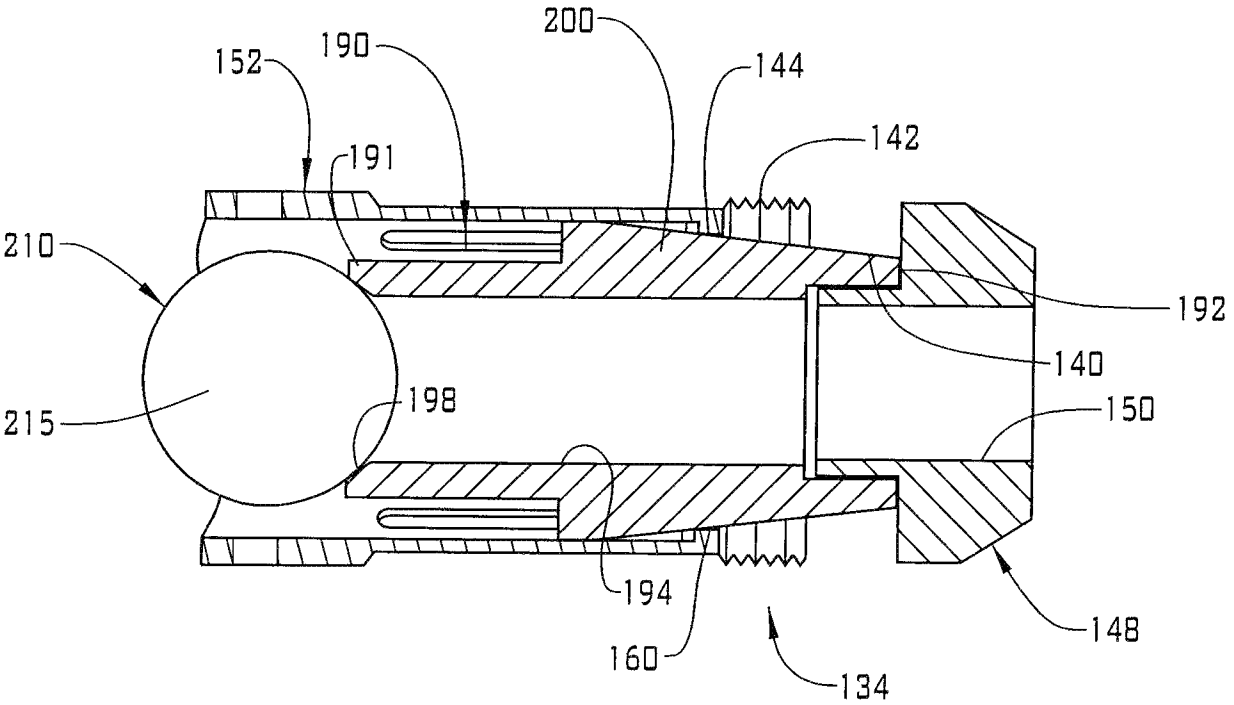
FIG. 8 depicts a cross-sectional view of the terminal end of the tool of FIG. 6 in a second or set configuration, in accordance with an aspect of an exemplary embodiment.

Reference will now follow to FIGS. 6-8, wherein like reference numbers represent corresponding parts in the respective views. In the embodiment shown, actuation mechanism 68 includes a power charge 184 that burns to create a gas that applies pressure to a piston element 188. Piston element 188 may act upon a setting member 190 to set seal member 134. Setting member 190 includes a first end portion 191 and a second end portion 192. A central conduit 194 extends through setting member 190 from first end portion 191 to second end portion 192. First end portion 191 defines a plug seat 198. Setting member 190 also includes a side portion 200 that is angled radially inwardly from first end portion 191 towards second end portion 192.

In operation, as gas is generated by burning power charge 184, pressure is applied against piston element 188. Piston element 188 shifts axially into seal member 134. Side portion 200 causes seal member 134 to expand radially outwardly as shown in FIG. 8

After casing tubular 40 has been perforated, and downhole tool 50 has been withdrawn from wellbore 34, a plug member 210, shown in the form of a drop ball 215, may be introduced into wellbore 34 and guided to plug seat 198 of setting member 190. At this point, surface system 16 may pump fluid into wellbore 34 to initiate a fracturing operation.

Figure 9:
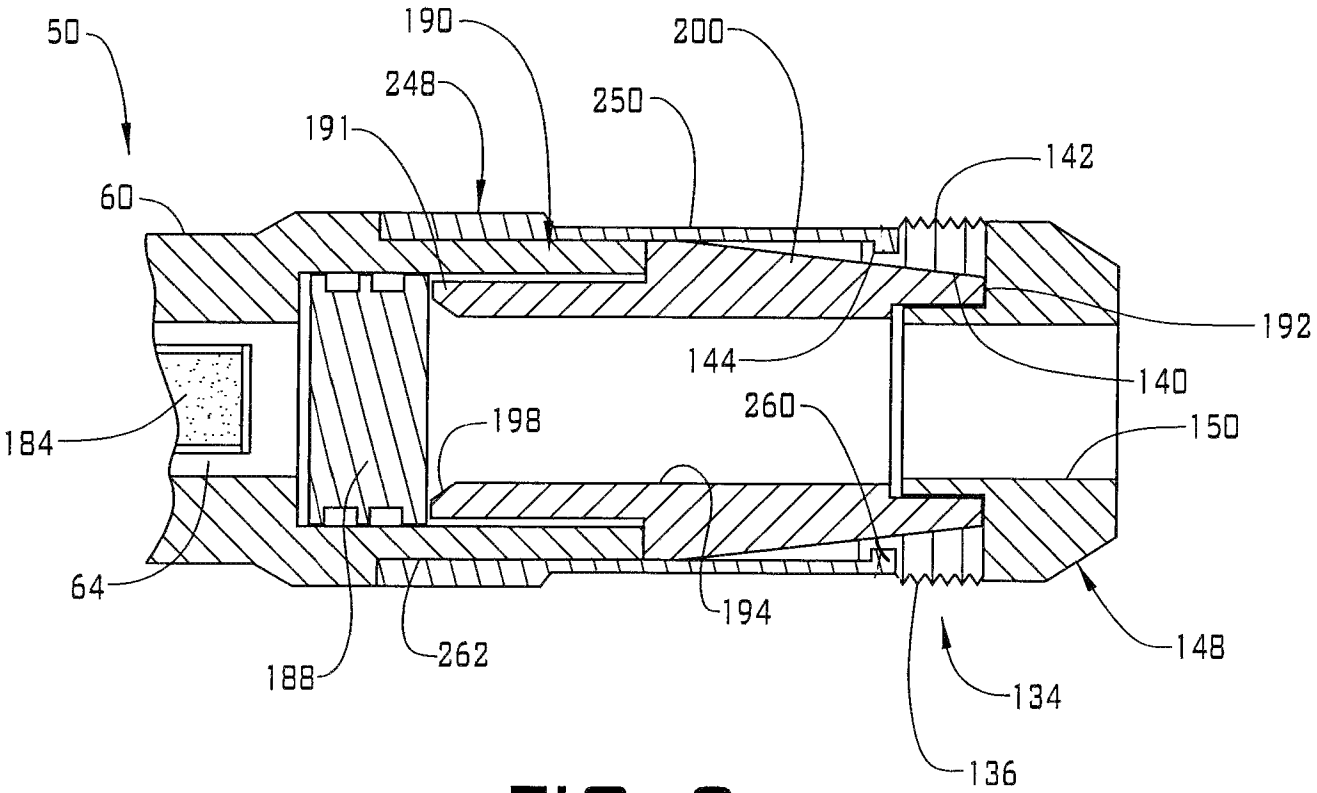
FIG. 9 depicts a cross-sectional view of the terminal end of the tool, in accordance with another aspect of an exemplary embodiment, in the first or unset configuration.

Reference will now follow to FIG. 9, wherein like reference numbers represent corresponding parts in the respective views, in describing collet member 248 including collet fingers 250 in accordance with another exemplary aspect. Collet fingers 250 include an inwardly directed member 260 that engages with recess 144 in seal member 134. Collet member 248 may be attached to outer surface 60 of downhole tool 50 through a plurality of threads 262. In the embodiment shown, inwardly directed members 260 are frangible. In accordance with another aspect, seal member 134 may include frangible portions. In this manner, once seal member 134 engages annular wall 38 collet fingers 250 may be disconnected.

Figure 10:
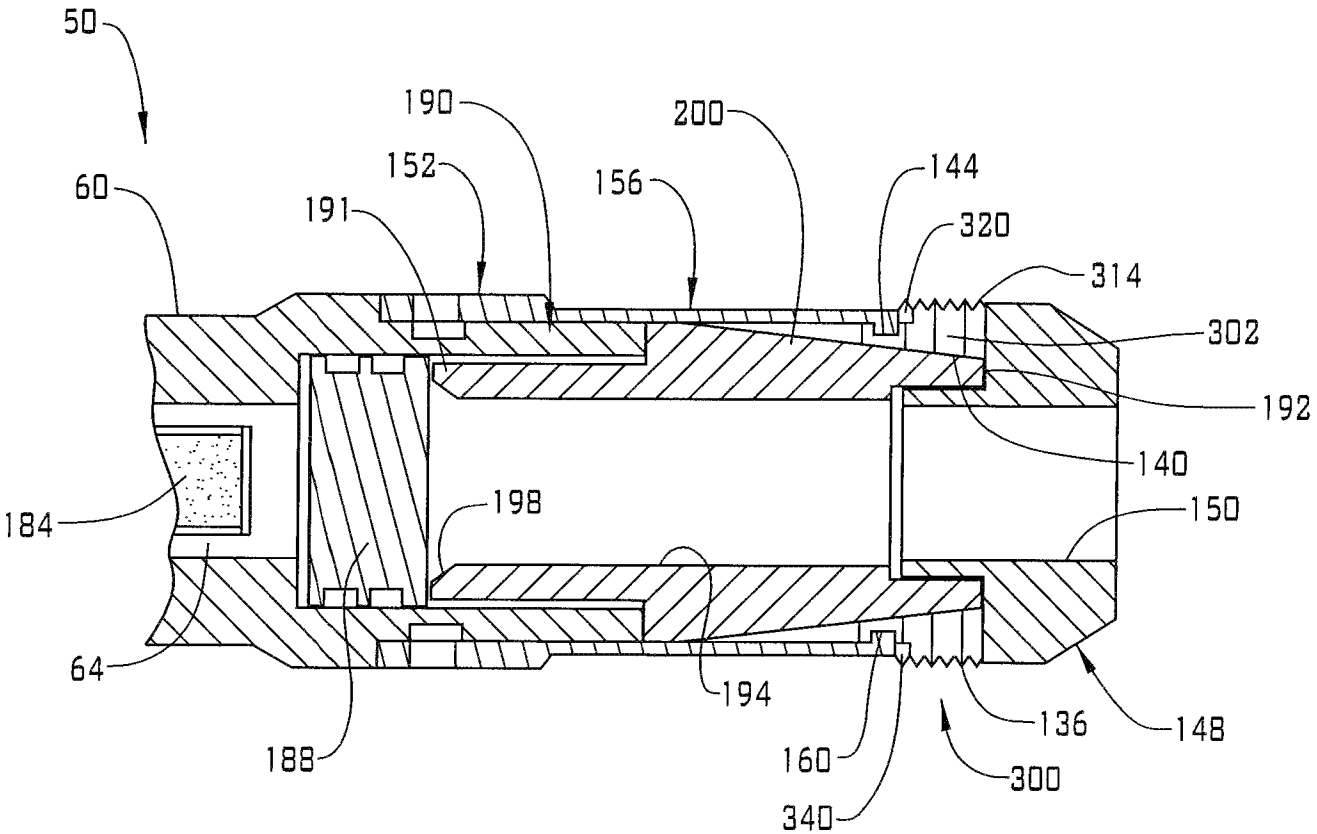
FIG. 10 depicts a cross-sectional view of the terminal end of the tool, in accordance with yet another aspect of an exemplary embodiment, in the first or unset configuration, in accordance with an aspect of an exemplary embodiment.

Reference will now follow to FIG. 10, wherein like reference numbers represent corresponding parts in the respective views, in describing a seal member 300 in accordance with another exemplary aspect. Seal member 300 includes an outer surface 302 having a plurality of wickers 314. A recess 320 is formed in outer surface 302 near inwardly directed members 160. Recess 320 may support a seal 340 formed from, for example, an elastomeric material. Seal 340 seats against annular wall 38 as seal member 300 is set in place.

Figure 11:
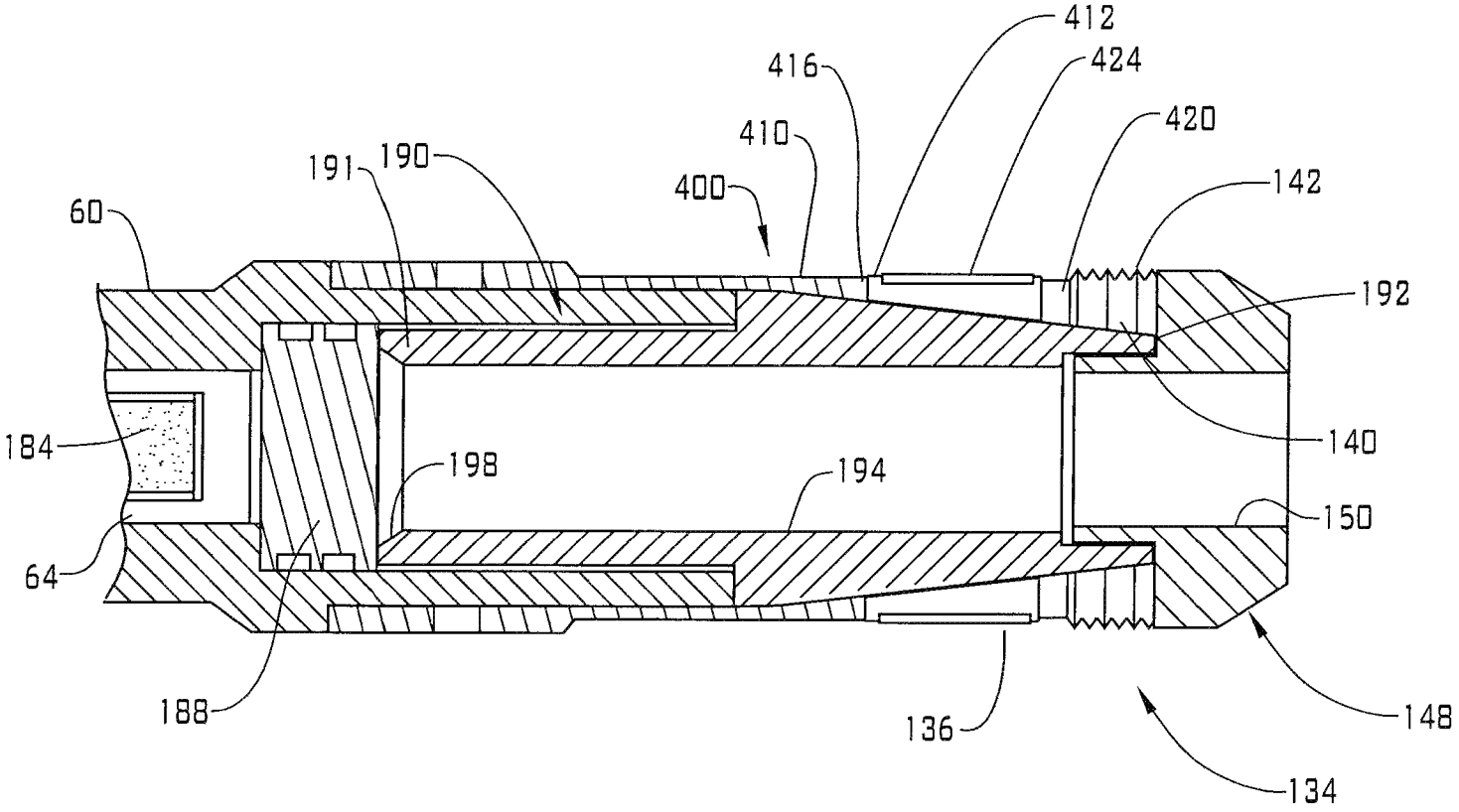
FIG. 11 depicts a cross-sectional view of the terminal end of the tool of FIG. 6 in a first or unset configuration, in accordance with another aspect of an exemplary embodiment.
Figure 12:
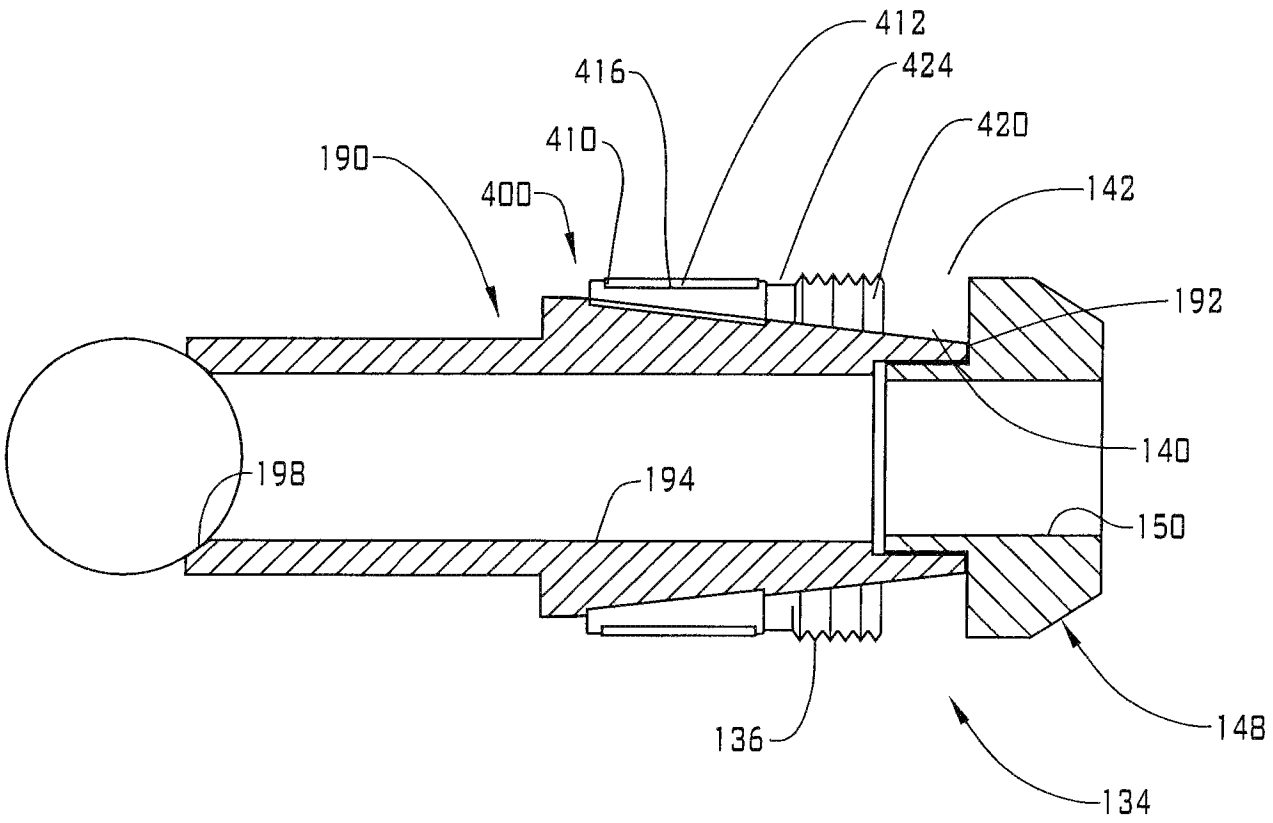
FIG. 12 depicts a cross-sectional view of the terminal end of the tool of FIG. 11 in a second or set configuration, in accordance with an aspect of an exemplary embodiment.

Reference will now follow to FIGS. 11 and 12, wherein like reference numbers represent corresponding parts in the respective views, in describing a collet member 400 in accordance with another aspect of an exemplary embodiment. Collet member 400 may include one or more collet fingers 410. Of course, it should be understood that collet member 400 may represent a continuous annular surface that is selectively expandable. Collet member 400 includes an end member 412 that is connected to collet fingers 410 through a frangible joint 416.

In an embodiment, end member 412 includes an outer surface 420 that supports a seal element 424. With this arrangement, as gas is generated by burning power charge 184, pressure is applied against piston element 188. Piston element 188 shifts axially toward seal member 134. Collet member 400 may be drawn in an uphole direction to seal element 424 against annular wall 38. Once set, additional force may be applied to collet member 400 causing frangible joint 416 to fail. Collet fingers 410 may then separate from end member 412 as shown in FIG. 12. After casing tubular 40 has been perforated, and downhole tool 50 has been withdrawn from wellbore 34, a plug member 210, shown in the form of a drop ball 215 may be introduced into wellbore 34 and guided to plug seat 198 of setting member 190. At this point, surface system 16 may pump fluid into wellbore 34 to initiate a fracturing operation.

Set forth below are some embodiments of the foregoing disclosure:

Embodiment 1

A downhole tool comprising: a setting tool including an outer surface, an inner surface defining a passage and a terminal end; an actuator mechanism arranged in the passage; a setting member arranged at the terminal end in the passage, the setting member including a side portion that is angled radially inwardly from a first end portion to a second end portion; a collet member extending over the setting member; and a seal member operatively connected to the collet member at the second end portion of the setting member.

Embodiment 2

The downhole tool according to any previous embodiment, wherein the setting member includes a central channel.

Embodiment 3

The downhole tool according to any previous embodiment, further comprising: a carrier member having a central opening that registers with the central channel arranged outwardly of the seal member, the seal member being arranged between the terminal end and the carrier member.

Embodiment 4

The downhole tool according to any previous embodiment, further comprising: a plug member arranged in the central channel, the plug member being selectively released to block the central opening of the carrier member.

Embodiment 5

The downhole tool according to any previous embodiment, further comprising: an actuator element fixedly arranged in the passage between the actuator mechanism and the setting member, to regulate fluid flow to the setting member.

Embodiment 6

The downhole tool according to any previous embodiment, further comprising: a piston slidingly arranged in the passage between the actuator mechanism and the setting member.

Embodiment 7

The downhole tool according to any previous embodiment, wherein the actuator mechanism comprises an explosive charge operable to form high pressure gases that act upon the setting member.

Embodiment 8

The downhole tool according to any previous embodiment, wherein the collet member includes one or more collet fingers each including a radially inwardly directed member that extends into a recess formed in the seal member.

Embodiment 9

The downhole tool according to any previous embodiment, wherein at least one of the radially inwardly directed member and the seal member is frangible.

Embodiment 10

The downhole tool according to any previous embodiment, wherein the one or more collet fingers is connected to the seal member through a frangible member.

Embodiment 11

The downhole tool according to any previous embodiment, wherein the seal member includes a seal element mounted to an outer surface of the collet member.

Embodiment 12

A method of setting a downhole seal comprising: delivering a fluid force onto a setting member; urging the setting member into a seal member; pulling on an outer surface of the seal member with a setting tool; and shifting the seal member along an angled surface of the setting member.

Embodiment 13

The method of any previous embodiment, wherein pulling on the outer surface includes applying a tensile force to the setting tool causing the outer surface of the setting tool to expand radially.

Embodiment 14

The method of any previous embodiment, wherein pulling on the outer surface of the seal member includes pulling on a collet including one or more collet fingers each with a radially inwardly directed member extending into a recess formed on an outer surface of the seal member.

Embodiment 15

The method of any previous embodiment, further comprising: disconnecting the one or more collet fingers from the seal member.

Embodiment 16

The method of any previous embodiment, further comprising: flowing a fluid about a plug member arranged in the setting member.

Embodiment 17

The method of any previous embodiment, wherein flowing the fluid about the plug member includes directing the fluid radially inwardly to a central channel formed in the setting tool.

Embodiment 18

The method of any previous embodiment, further comprising: dislodging the plug member to cut off flow through the setting member.

Embodiment 19

The method of any previous embodiment, further comprising: disconnecting the setting tool by breaking a frangible member connecting the setting tool to the seal member.

Embodiment 20

The method of any previous embodiment, wherein urging the setting member into the seal member includes delivering a metered flow of fluid into a rear portion of the setting member.

Embodiment 21

The method of any previous embodiment, wherein urging the setting member into the seal member includes delivering a flow of fluid onto a piston arranged adjacent to a rear portion of the setting member.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of setting a downhole seal comprising:
delivering a fluid force onto a setting member;
urging the setting member into a seal member;
pulling on an outer surface of the seal member with a setting tool; and
shifting the seal member along an angled surface of the setting member.

2. The method of claim 1, wherein pulling on the outer surface includes applying a tensile force to the setting tool causing the outer surface of the setting tool to expand radially.

3. The method of claim 1, wherein pulling on the outer surface of the seal member includes pulling on a collet including one or more collet fingers each with a radially inwardly directed member extending into a recess formed on an outer surface of the seal member.

4. The method of claim 3, further comprising: disconnecting the one or more collet fingers from the seal member.

5. The method of claim 1, further comprising: flowing a fluid about a plug member arranged in the setting member.

6. The method of claim 5, wherein flowing the fluid about the plug member includes directing the fluid radially inwardly to a central channel formed in the setting tool.

7. The method of claim 5, further comprising: dislodging the plug member to cut off flow through the setting member.

8. The method of claim 1, further comprising: disconnecting the setting tool by breaking a frangible member connecting the setting tool to the seal member.

9. The method of claim 1, wherein urging the setting member into the seal member includes delivering a metered flow of fluid into a rear portion of the setting member.

10. The method of claim 1, wherein urging the setting member into the seal member includes delivering a flow of fluid onto a piston arranged adjacent to a rear portion of the setting member.

* * * * *